United States Patent [19]

Kempa

[11] Patent Number: 4,634,087

[45] Date of Patent: Jan. 6, 1987

[54] GROOVED RAIL SWITCH WITH A TONGUE RAIL DEVICE

[75] Inventor: Bernd-Joachim Kempa, Berlin, Fed. Rep. of Germany

[73] Assignee: Elektro-Thermit GmbH, Berlin, Fed. Rep. of Germany

[21] Appl. No.: 676,544

[22] Filed: Nov. 30, 1984

[30] Foreign Application Priority Data

Nov. 30, 1983 [DE] Fed. Rep. of Germany ..... 3343239

[51] Int. Cl.[4] ..... E01B 7/06; E01B 7/02

[52] U.S. Cl. ..... 246/430; 246/434; 246/435 R; 246/453

[58] Field of Search ..... 246/435 R, 434, 438, 246/439, 442, 453, 430, 415 R, 467

[56] References Cited

U.S. PATENT DOCUMENTS

| | | | |
|---|---|---|---|
| 530,201 | 12/1894 | O'Shea | 246/442 |
| 705,056 | 7/1902 | Ervin | 246/442 |
| 1,049,618 | 1/1913 | Steedman | 246/442 |
| 1,301,099 | 4/1919 | Burton | 246/435 R |
| 2,231,232 | 2/1941 | Theodos | 246/442 |

FOREIGN PATENT DOCUMENTS

| | | | |
|---|---|---|---|
| 351643 | 11/1920 | Fed. Rep. of Germany | 246/442 |
| 403320 | 4/1923 | Fed. Rep. of Germany | 246/442 |
| 1131711 | 6/1962 | Fed. Rep. of Germany | 246/435 R |

*Primary Examiner*—Robert B. Reeves
*Assistant Examiner*—Scott H. Werny
*Attorney, Agent, or Firm*—Toren, McGeady & Goldberg

[57] ABSTRACT

A grooved rail switch with a tongue rail device includes a tongue rail displaceably supported on a torsion-stiff support box for movement between a stock rail and a switch rail. The support box is made up of an upper slide plate, a lower bottom plate and flat bars extending between and welded to the slide plate and bottom plate. High strength bolts secure the stock rail to one side of the support box and the switch rail to the other side.

5 Claims, 4 Drawing Figures

GROOVED RAIL SWITCH WITH A TONGUE RAIL DEVICE

BACKGROUND OF THE INVENTION

The invention is directed to a tongue rail device for a grooved rail switch with a tongue rail being displaceable between a stock rail and a switch rail supported by a slide plate and being movable by a setting device.

Usually, the slide plate is joined to the web of the stock and switch rail by weld seams. For increased stability, both of the rails have a supporting seat in the web region in the form of a rolled-in shoulder for a welded-on strip so that the slide plate is positioned on the supporting seat and then welded. The stock rail and the switch rail rest on a base plate and are connected to it by weld seams. Such a design is displayed in German Utility Model No. 69 16 985, FIG. 2.

This design, still in use at the present time, has several disadvantages. For example, special rolled sections are required for the stock rail and the switch rail and these sections are disproportionately expensive, since they are needed only in limited lengths and must be manufactured specially. Since the manufacturer of such special sections can perform the rolling for only a certain minimum quantity, the switch manufacturer must place long-term orders and keep these special sections in stock at great expense.

Another disadvantage of this known design is that the bottom or base plate, to which the stock rail and switch rail are welded, is about 15 mm thick and, accordingly, the tongue or tongue rail is higher by the thickness of the bottom plate than the adjacent track rails. When installing such a switch, the difference in height must be compensated by other construction measures.

The stock rail with the required special rolled shape (type designation BA 75) normally has an average carbon content of 0.6% with the result that welding can be performed only after adequate preheating. Even with preheating and carefully performed welding, there is the danger of an incipient crack in the region of the stock rail at the ends of the bottom plate, because in this region the weld seam exerts a notch effect. There is also the danger that additional cracks will develop due to the inevitable aligning of the tongue rail after welding. Automatic performance of the welding is difficult because of the poor accessibility of the weld seams between the stock or switch rail and the slide plate.

Because of the warpage or distortion that takes place during the welding of such a construction, the cost of installing such a switch is very high. The tongue rail and slide plate must be carefully adapted to one another to ensure a uniform and continuous seating for the tongue rail. Such an operation involves considerable grinding expense.

There are other known tongue rail devices where the slide plate is screwed to the webs of the stock rail and of the switch rail. Such a design is disclosed in the German Patentschrift No. 826 307 and the patent application No. G 15126 V/19a. In such an arrangement there is the disadvantage, particularly if the seating of the stock rail and the switch rail on the track bed is not flat, that the screw connections will loosen in the course of time and safe operation of the switch cannot be assured. Moreover, in this arrangement the inner side of the webs of the stock rail and of the switch rail must be provided with webs or shoulders on which the slide plate can be supported.

Such an arrangement where the parts are screwed together has not been usable in public transportation, such as by streetcar or inter-urban lines.

SUMMARY OF THE INVENTION

Therefore, it is the primary object of the present invention to provide a tongue rail device where the abovementioned disadvantages are eliminated, while the high stability of the welded construction is preserved. The tongue rail device of the present invention can be assembled using standard sections, and, in particular, sections which are available in steel grades that can be effectively welded.

Surprisingly, it has been found that the problem to which the present invention is directed, can be solved using an arrangement in which the tongue rail support box is formed by an upper slide plate and a lower bottom plate welded together using a pair of laterally spaced flat bars extending between the two plates. As a result, a torsion-stiff tongue rail support box is formed. The stock rail and the switch rail can be secured to the support box by means of high strength bolts.

In accordance with the present invention, the slide plate and the bottom plate are formed as a separate unit, instead of the prior art arrangement where the two plates formed a fixed frame with the stock rail and the guide rail. Such a separate unit in the form of a torsion-stiff tongue rail support box is formed, in accordance with the present invention, by the slide plate and a similarly shaped bottom plate with laterally spaced flat bars extending between the two plates so that the combination of the plates and the bars are joined together along welded seams. As a result, the vertically arranged flat bars take over the supporting function previously provided by the stock and switch rails.

The bottom plate and the vertically extending flat bars can be formed from structural steels according to DIN 17,100 with a carbon content of up to 0.25% so that the welding can be carried out without preheating. It is necessary to form the slide plate from a wear-resistant grade of steel because of its position. As a result, alloyed steels have proved to be satisfactory, since such steels have a high strength combined with good toughness and wear properties along with being weldable without preheating.

After the tongue rail support box is welded, the slide plate is machined by chipping to obtain a continuous support for the tongue rail. To install the tongue rail device embodied in the present invention, the stock rail and the switch rail are secured to the torsion-stiff support box using high-strength bolts which are inserted horizontally through the rails and the support box. Next the tongue is inserted with one end portion being shaped to conform to the profile of the inserting rail and the tongue rail and inserting rail are welded together. In place of a welded connection, a butt-strapped biased joint can be used.

To shift or displace the tongue rail between the stock rail and the switch rail, a conventional setting device may be used. The setting device is connected with a peg on the lower portion of the tongue rail at the opposite end from the connection to the inserting rail. In a preferred embodiment of the tongue rail device according to the present invention, the tongue rail support box in the region of the end of the tongue spaced from the inserting rail, has cutouts to receive the peg on the tongue rail so that the tongue rail peg can be engaged by the tongue rail setting device.

Further, the bottom plate can have a corresponding cutout aligned below the cutout in the slide plate so that water, such as rain water, can drain out of the support box.

To afford a smooth transition from the guide edge of the inserting rail to the guide edge of the switch rail, the switch rail has a recess for receiving the guide rail of the inserting rail.

Further, to increase the mechanical stability and, accordingly, the safe operation of the device, the tongue rail support box is arranged so that the tongue rail base can be attached on its side facing the switch rail. Such a preferred form of the tongue rail device, according to the present invention, is characterized in that in the region of the end of the tongue rail contiguous to the inserting rail, a cutout portion is formed in the support box dimensioned to match the base of the tongue rail and having a corresponding height. The stock rail can be bolted to the support box in the region of the cutout as well as to the tongue rail base, to a lining piece and to the switch rail. Accordingly, the position of the tongue rail adjacent the inserting rail is determined. A particular advantage of this arrangement is that the end of the tongue rail is firmly clamped behind the spring location and ahead of the weld location of one end of the tongue rail to the inserting rail. Thus, the danger of cracks or ruptures in the region of the weld is eliminated.

Accordingly, the tongue device embodying the present invention offers a number of special advantages concerning the manufacture of the device and/or the safety of its operation:

The support box of the tongue rail device can be produced expediently by welding machines. No special sections are required, rather standard sections can be employed and the cost of stock-keeping can be maintained low. By using steel materials containing less than 0.25% carbon, in the welding operation preheating can be avoided. Installation is greatly facilitated, since welding operations after the chip machining are no longer required and thus heat warped. parts are precluded. The tongue rail device has the same structural height as the connecting tracks. Therefore, no additional work is required to compensate for differences in height. The overall device affords a stable, torsion-stiff unit, and it can be assembled from prefabricated parts at the installation site. The danger of breaks, cracks or other damage, especially in the region of the tongue rail, is eliminated to a considerable extent.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
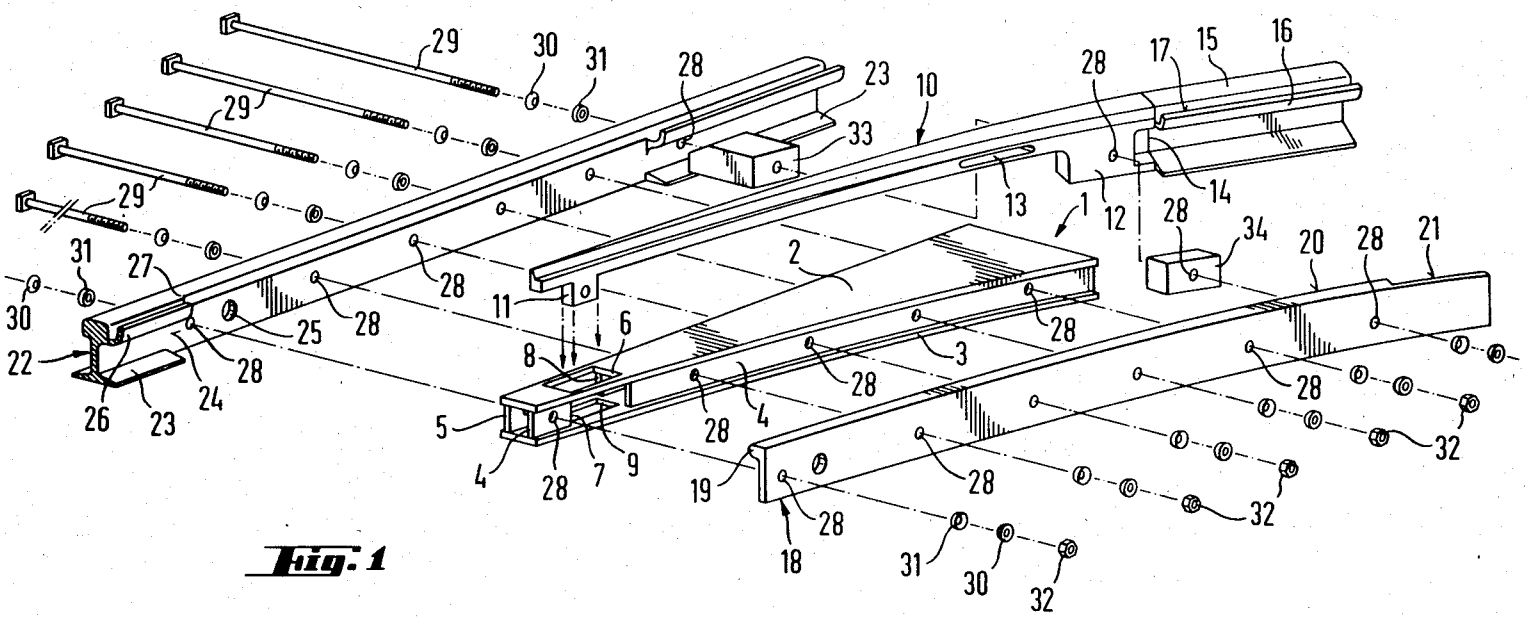
FIG. 1 is a perspective view showing the grooved rail switch and tongue rail device in an exploded manner.
Figure 3:
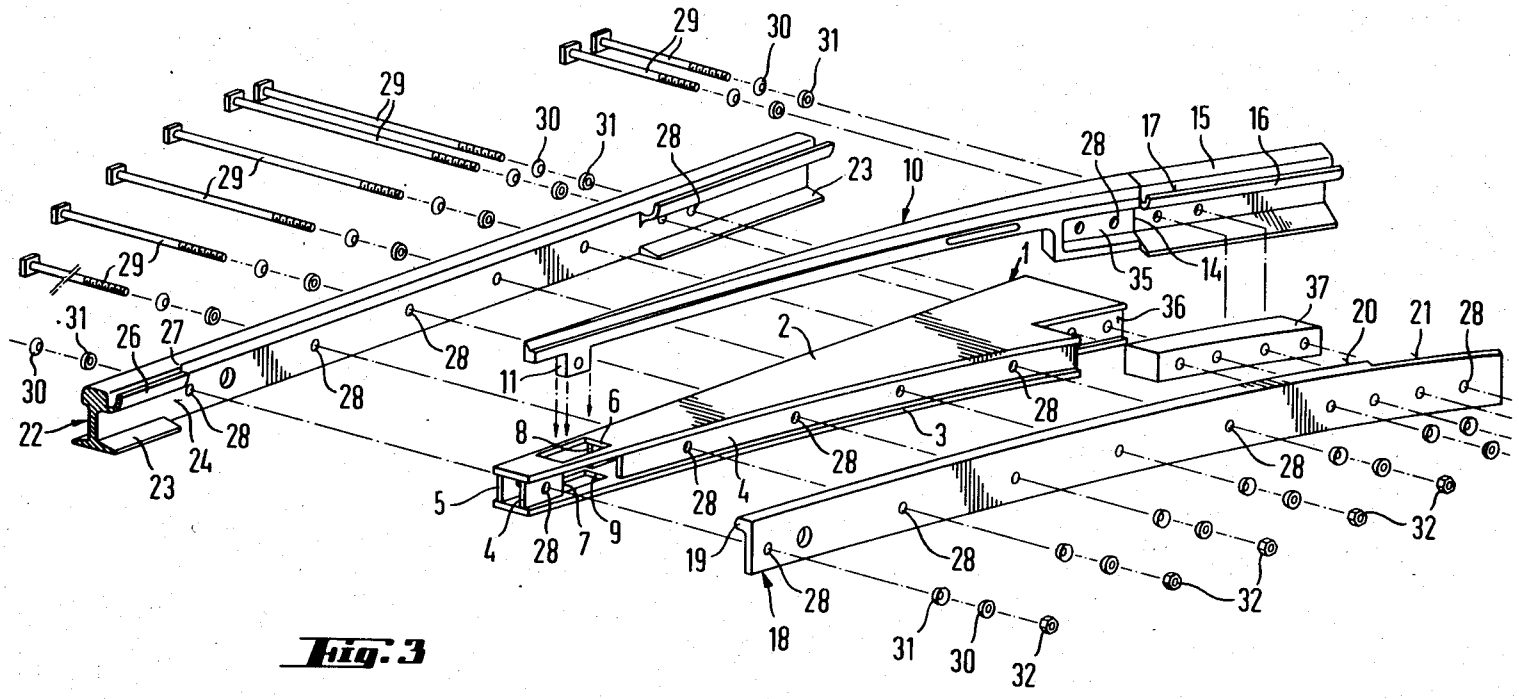
FIG. 3 is a perspective view, similar to FIG. 1, however, showing another embodiment of the present invention.

In the drawing the same reference numerals are used for corresponding parts. In FIG. 1 a tongue rail support box 1 is illustrated. The tongue rail support box is made up of a generally horizontally arranged slide plate 2, a generally horizontally arranged bottom plate 3 spaced below the slide plate with the slide plate and bottom plate being shaped correspondingly. Vertically arranged flat bars 4 and 5 extend between the bottom plate and the slide plate. The flat bars are divided into two sections and are joined to the slide plate 2 and the bottom plate 3 by a weld seam. The support box 1 and the parts forming the support box have a first end at the left and a second end on the right as viewed in the drawings. The other parts of the switch have a first end on the left and a second end on the right, similar to the support box 1. As can be seen in FIGS. 1 and 3 the gaps 7,8 are located adjacent the first end of the support box 1. Further, in the region of the gaps 7,8, the slide plate 2 has a cutout 6 and the bottom plate 3 has a corresponding cutout 9. To prevent the entry of water into the support box 1 it is useful to seal the first and second ends of the box by providing another flat bar extending across the ends of the flat bars 4 and 5. Flat bars 4 and 5 have bores 28 extending through them with the bores spaced apart in the direction between the first and second ends of the support box 1. The bores 28 are used for the assembly of the tongue rail device to the switch. After the tongue rail support box 1 is assembled, the upper surface of the slide plate 2 is machined by chipping and grinding so that the part of the tongue rail supported on and displaceable over the surface of the slide plate is uniformly supported.

Tongue rail 10 is formed from a solid section and extends between a first end and a second end and has a base 12 at its second end which has a height comparable to that of an inserting rail 15 extending from the second end of the tongue rail. At the second end, the base 12 is welded to the inserting rail 15 as indicated. Base 12 contains a bore 28. Spaced closely from the base 12 of the tongue rail 10, in the direction toward the first end, is a spring location 13 so that the tongue rail can be placed against a stock rail 22 or a switch rail 18. Note that the stock rail and the switch rail are generally coextensive with the tongue rail 10 and inserting rail 15 and also with the support box 1 for a portion of their length. Adjacent its first end, the tongue rail 10 has a downwardly projecting peg 11 containing a bore. A setting element, not shown, of a switch setting device engages the peg.

Switch rail 18 is formed from a standard section and has bores 28 for use in assembling the arrangement. Adjacent its second end, in the region facing toward the inserting rail, the projection 19 extending toward the stock rail 22 has a recess 21. Recess 21 is dimensioned so that the guide rail 16 on the inserting rail 15 fits into the recess 21 with the guide edge 17 on the inserting rail being aligned with the guide edge 20 on the projection 19 of the switch rail so that a smooth transition is afforded.

Stock rail 22 is formed of a conventional grooved rail, note the cross-section of the stock rail shown at its first end and the rail flange 23 located at the base of the switch rail On the side of the stock rail 22 facing the switch rail 18, the rail flange 23 is cut away so that the tongue rail support box 1 abuts against the web 24 of the stock rail. The head of the stock rail 22 is shaped to match the abutting face of the tongue rail 10 so that when the tongue rail bears against the head of the stock rail, a smooth run of the wheel in the region 27 adjacent the first end of the stock rail is afforded. The stock rail 22 also has bores 28 extending through it.

When assembling the tongue rail device according to the present invention, in the grooved rail switch, the stock rail 22, the support box 1 and the switch rail 18 are secured together by high strength bolts 29 extending through the aligned bores 28. To compensate for the oblique position between the bolt heads and the stock rail as well as between the nuts 32 and the switch rail 18, spherical discs 30 and conical sockets 31 are slipped into the bolts and then the nuts are screwed on. After this assembly operation, tongue rail 10 is placed on the support box 1 with its peg 11 extending downwardly through the cutout 6 in the slide plate 2. The base 12 of the tongue rail is located directly adjacent the second end or wider end of the support box 1. Similarly, the tongue rail 10 is secured in place by placing a bolt 29 through the bore 28 adjacent the second end of the stock rail, then through the spacer 33, the base 12, the spacer 34, and the last bore 28 adjacent the second end of the switch rail 18.

Figure 2:
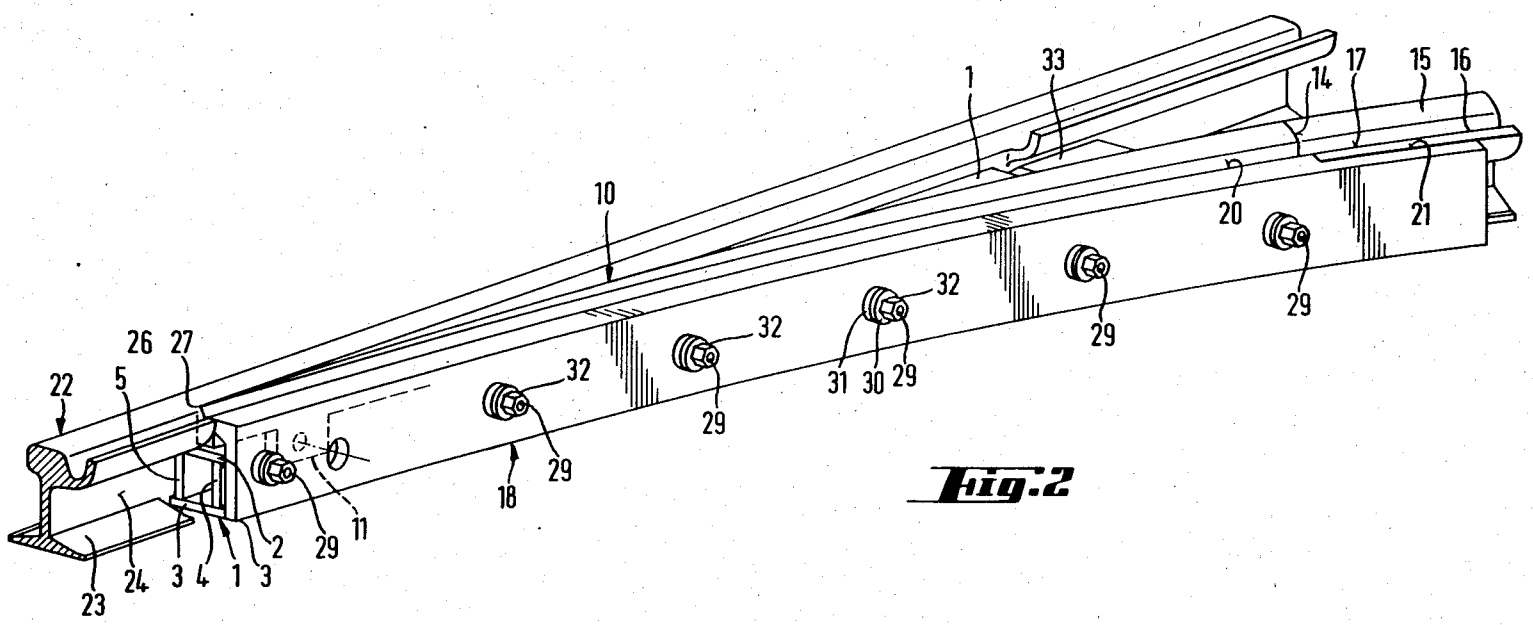
FIG. 2 is a perspective view showing the grooved rail switch and the tongue rail device assembled.

In FIG. 2, the tongue rail device is shown assembled in the switch with the tongue rail positioned against the stock rail. At the first end of the tongue rail, the first end of the support box 1 can be seen formed by the slide plate 2, the bottom plate 3 and the flat bars 4 and 5. As can be seen in FIG. 2 there is an opening in the web of the switch rail 18 aligned with the opening in the peg 11 so that the attachment of the setting element of the setting device can be effected to the tongue rail peg 11. At its second end, tongue rail 10 is welded to the inserting rail 15 at the joint 14. Guiding edge 17 of the inserting rail 15 is aligned with the guiding edge 20 of the switch rail 18.

FIG. 3 displays another preferred embodiment of the tongue rail device in accordance with the present invention. In this embodiment the switch rail 18 and the stock rail 22 are substantially unchanged. The tongue rail support box 1, however, differs from the box shown in FIG. 1 in that the second end of the box in the region of the base 35 of the tongue rail extends up to the joint 14 between the tongue rail and the inserting rail 15. Further, on the side of the support box 1 facing the switch rail 18 there is a cut-away portion 36 dimensioned to correspond to the base 35 of the tongue rail 10. During assembly, base 35 of the tongue rail 10 is inserted into the cut-away portion 36 of the support box and in conjunction with a spacer plate 37 and a specially stable and loadable connection of the tongue rail 10 and the inserting rail 15 with the support box 1, the stock rail 22 and the switch rail 18 is obtained. There is the special advantage in this arrangement with the attachment of the base 35 in the cut-away portion 36 that the weld 14 is protected from mechanical tensile or compressive stresses during any displacement back and forth of the tongue rail. All of the other parts of the tongue rail device shown in FIG. 3 correspond to the device as shown in FIG. 1, accordingly, further description is not necessary.

Figure 4:
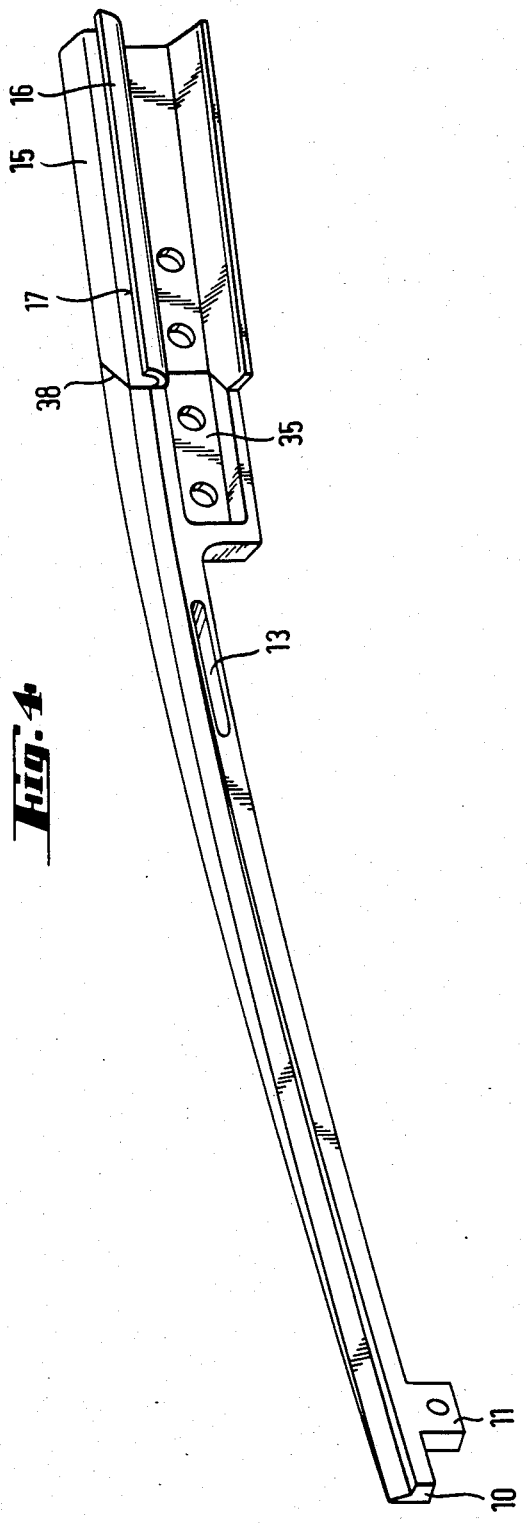
FIG. 4 is a perspective view of another embodiment of the connection between the tongue rail and the inserting rail.

In FIG. 4 a special embodiment is shown of the connection between the tongue rail 10 and the inserting rail 15 suitable for use in the device illustrated in FIG. 3. In this special embodiment, the inserting rail 15 is not welded to the tongue rail 10, rather a bias joint 38 is provided and the connection is afforded by bolts in combination with the spacer plate 37.

While specific embodiments of the invention have been shown and described in detail to illustrate the application of the inventive principles, it will be understood that the invention may be embodied otherwise without departing from such principles.

I claim:

1. Grooved rail switch with a tongue rail device comprising an elongated stock rail having a first end and a second end, an elongated switch rail separate from said stock rail and having a first end and a second end and extending alongside said stock rail, said tongue rail device comprises an elongated tongue rail having a first end and a second end extending alongside and located between said stock rail and said switch rail, and means for supporting said tongue rail separate from said stock rail and said switch rail for displacement laterally of said tongue rail between said stock rail an said switch rail, said means comprises a generally horizontally arranged slide plate for slidably supporting said tongue rail for lateral displacement between said stock rail and said switch rail along the length of said tongue rail in the first end-second end direction, said slide plate having a first end and a second end, a generally horizontally arranged bottom plate spaced below said slide plate having a corresponding first end and a second end, a pair of generally vertically arranged laterally spaced flat bars each extending upwardly from said bottom plate to said slide plate and extending in the direction from the first ends to the second ends of said slide plate and bottom plate, said flat bars being welded to said slide plate and bottom plate, said slide plate, bottom plate and flat bars forming a torsion-stiff tongue rail support box having a first end and a second end, and high-strength bolts extending transversely of and spaced apart in the first end-second end direction of said stock rail and switch rail and extending through said stock rail said support box and said switch for removably securing said stock rail and switch rail to said support box, an inserting rail has a first end abutting against the second end of said tongue rail and said inserting rail extends in general alignment with and away from said tongue rail, the second end of said support box extends to the first end of said inserting rail and said support box on the side adjacent said switch rail is cut out to correspond to the shape of said tongue rail adjacent said second end thereof, a spacer plate positioned between the second end of said tongue rail and the second end of said switch rail, and a bolt extends through said stock rail and said support box in the region of said cutaway portion extending through said tongue rail and said spacer plate and through said switch rail.

2. Grooved rail switch, as set forth in claim 1, wherein adjacent the first end of said support box cutouts are provided in said slide plate and said flat bars, said tongue rail has a peg asjacent the first end thereof insertable through said cutout in said slide plate, and said cutouts in said flat bars arranged to receive a member for displaceably positioning said tongue rail between said stock rail and said switch rail.

3. Grooved rail switch, as set forth in claim 2, wherein said bottom plate has a cutout therein aligned below the cutout in said slide plate.

4. Grooved rail switch, as set forth in claim 1, 2 or 3 wherein said switch has a recess therein extending from the second end thereof, and said inserting rail extending from the first end thereof has a guide rail arranged to fit into said recess in said switch rail for forming a continuous guiding edge.

5. Grooved rail switch, as set forth in claim 1, 2 or 3, wherein said tongue rail has a base located at the second end thereof and extending therefrom toward and spaced a considerable distance from the first end of said support rail, and a spring location located in said tongue rail adjacent to and spaced from said base toward the first end of said tongue rail.

* * * * *